US010768551B2

(12) United States Patent
Mimura

(10) Patent No.: US 10,768,551 B2
(45) Date of Patent: Sep. 8, 2020

(54) CONVEYING SCREW, TONER CONTAINER AND IMAGE FORMING APPARATUS

(71) Applicant: KYOCERA Document Solutions Inc., Osaka (JP)

(72) Inventor: Daisuke Mimura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/548,344

(22) Filed: Aug. 22, 2019

(65) Prior Publication Data

US 2020/0073284 A1 Mar. 5, 2020

(30) Foreign Application Priority Data

Aug. 30, 2018 (JP) ..... 2018-162073

(51) Int. Cl.
*G03G 15/08* (2006.01)

(52) U.S. Cl.
CPC ..... *G03G 15/0891* (2013.01)

(58) Field of Classification Search
CPC combination set(s) only.
See application file for complete search history.

(56) References Cited

U.S. PATENT DOCUMENTS

2008/0205936 A1* 8/2008 Brown ..... G03G 15/0877 399/254

FOREIGN PATENT DOCUMENTS

JP 2009-210721 A 9/2009

* cited by examiner

*Primary Examiner* — Victor Verbitsky
(74) *Attorney, Agent, or Firm* — Studebaker & Brackett PC

(57) ABSTRACT

A conveying screw configured to convey a toner in an axial direction includes a conveying shaft part and a conveying blade. The conveying shaft part is configured to be rotated around an axis. The conveying blade is spirally formed around an outer circumferential face of the conveying shaft part and configured to convey a toner in a replenishment path. At least one spiral of the conveying blade is formed by two semicircular blade plates which are coupled to in postures inclined in opposite directions to each other. A through hole through which the toner is passed in the axial direction is formed in an area surrounded by the conveying shaft part and the two blade plates.

8 Claims, 12 Drawing Sheets

CONVEYING SCREW, TONER CONTAINER AND IMAGE FORMING APPARATUS

INCORPORATION BY REFERENCE

This application is based on and claims the benefit of priority from Japanese patent application No. 2018-162073 filed on Aug. 30, 2018, which is incorporated by reference in its entirety.

BACKGROUND

The present disclosure relates to a conveying screw configured to convey a toner (a developer), a toner container and an image forming apparatus.

An electrophotographic type image forming apparatus includes a conveying screw configured to convey a toner (a developer).

For example, there is a dispense auger rotating in a toner supply path communicating a toner storage chamber with a development chamber. The dispense auger includes a spiral blade part formed around a rotational shaft, and the spiral blade is configured such that a pitch of the spiral blade is gradually narrowed from an upstream side to a downstream side in a conveyance direction of the toner. This makes a compressive force of the toner gradually high toward the downstream side in the conveyance direction to decrease an occurrence of a void at the downstream side in the conveyance direction. As a result, it becomes possible to make a supply amount of the toner stable regardless of an amount of the toner in the toner storage chamber.

SUMMARY

In accordance with an aspect of the present disclosure, a conveying screw configured to convey a toner in an axial direction includes a conveying shaft part and a conveying blade. The conveying shaft part is configured to be rotated around an axis. The conveying blade is spirally formed around an outer circumferential face of the conveying shaft part and configured to convey a toner in a replenishment path. At least one spiral of the conveying blade is formed by two semicircular blade plates which are coupled to in postures inclined in opposite directions to each other. A through hole through which the toner is passed in the axial direction is formed in an area surrounded by the conveying shaft part and the two blade plates.

In accordance with an aspect of the present disclosure, a toner container includes a container main body and a conveying screw. The container main body is configured to store a toner and to include a replenishment path communicated with a destination. The conveying screw is configured to convey the toner stored in the container main body in an axial direction. The conveying screw includes a conveying shaft part and a conveying blade. The conveying shaft part is configured to be rotated around an axis. The conveying blade is spirally formed around an outer circumferential face of the conveying shaft part and configured to convey the toner in the replenishment path. At least one spiral of the conveying blade is formed by two semicircular blade plates which are coupled to in postures inclined in opposite directions to each other. A through hole through which the toner is passed in the axial direction is formed in an area surrounded by the conveying shaft part and the two blade plates.

In accordance with an aspect of the present disclosure, an image forming apparatus includes the above described toner container.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Hereinafter, with reference to the attached drawings, an embodiment of the present disclosure will be described. Fr, Rr, L, R, U and D marked in each figure respectively indicate a front side, a rear side, a left side, a right side, an upper side and a lower side.

Figure 1:
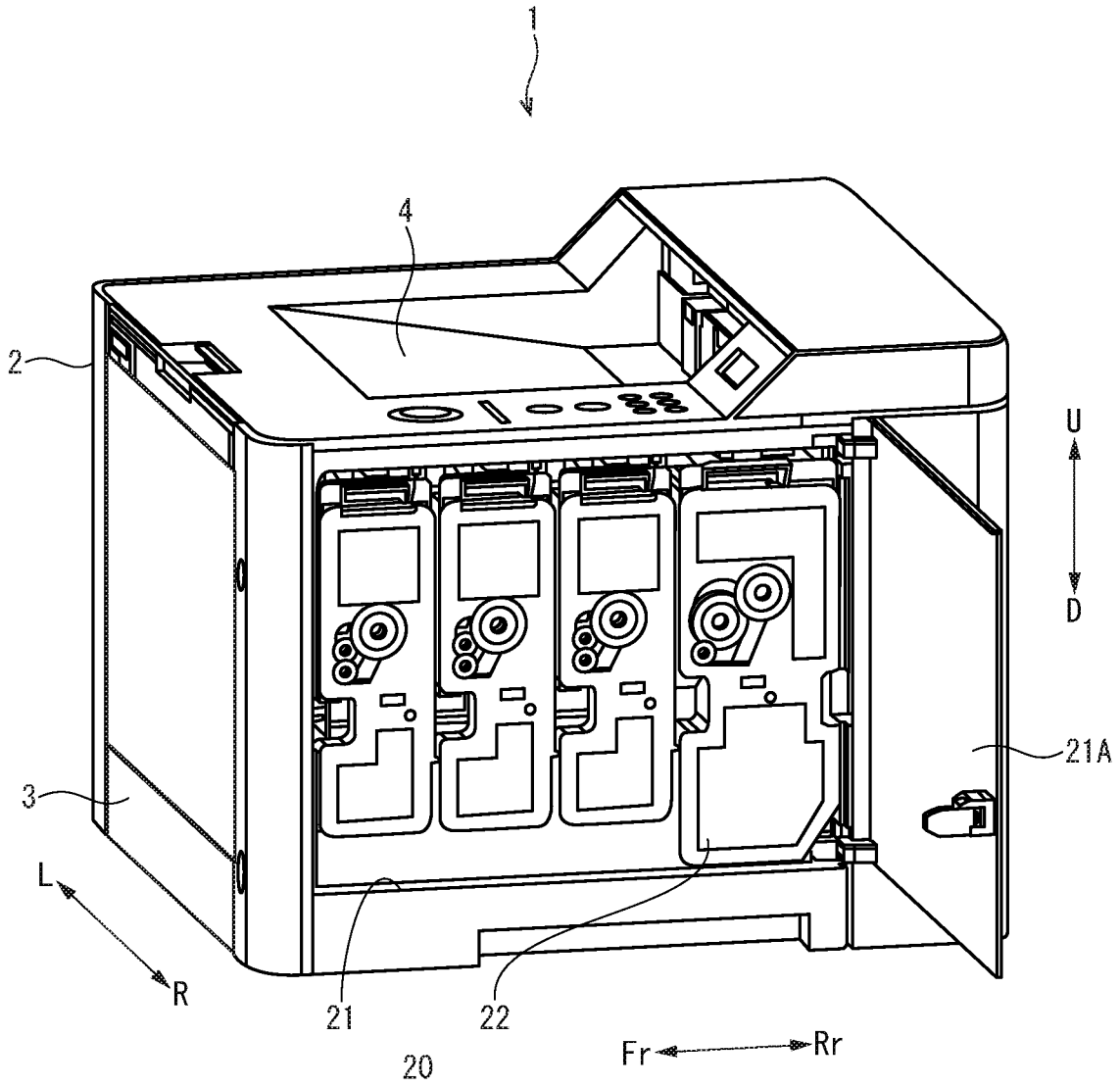
FIG. 1 is a perspective view showing a color printer according to one embodiment of the present disclosure.
Figure 2:
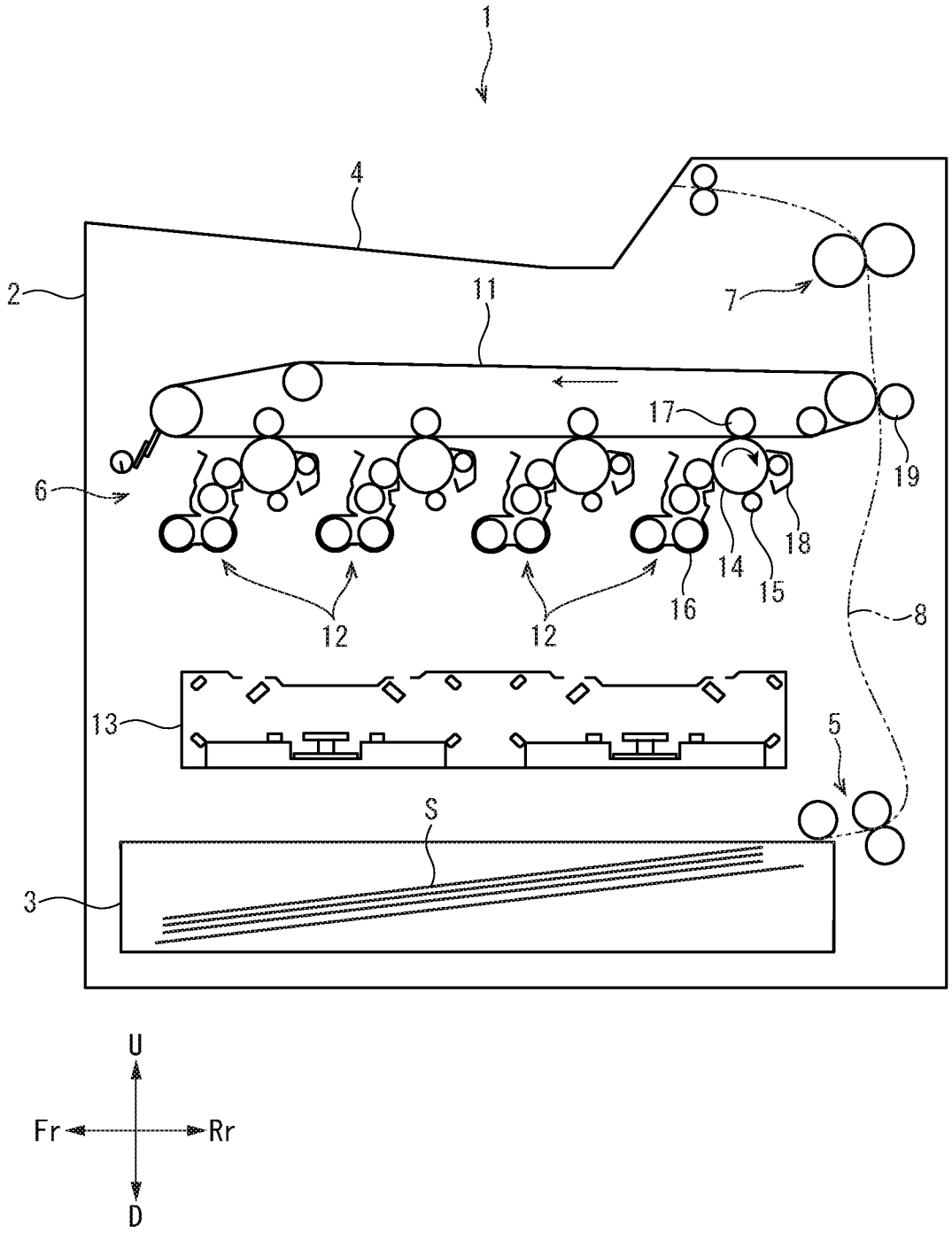
FIG. 2 is a view (a side view) schematically showing an inner structure of the color printer according to the embodiment of the present disclosure.

[A first embodiment: an outline of a color printer] With reference to FIG. 1 and FIG. 2, an entire structure of a color printer 1 as an example of an image forming apparatus 1 will be described. FIG. 1 is a perspective view showing the color printer 1. FIG. 2 is a view (a side view) schematically showing an inner structure of the color printer 1.

As shown in FIG. 1 and FIG. 2, the color printer includes an apparatus main body 2 formed in an approximately parallelepiped shape. In a lower portion of the apparatus main body 2, a sheet feeding cassette 3 configured to store a paper sheet S (refer to FIG. 2) is detachably attached. On an upper face of the apparatus main body 2, a discharge tray 4 is provided. The sheet S is not limited to the paper sheet; may be a resin sheet or the others.

As shown in FIG. 2, the color printer 1 includes a sheet feeding device 5, an image forming device 6, a fixing device 7 and a toner replenishment device 20 (refer to FIG. 1) which are stored inside the apparatus main body 2. The sheet feeding device 5 is provided at an upstream end portion of a conveyance path 8 extending from the sheet feeding cassette 3 to the discharge tray 4. The fixing device 7 is provided at a downstream side of the conveyance path 8, and the image forming device 6 is provided on the conveyance path 8 between the sheet feeding device 5 and the fixing device 7.

As shown in FIG. 1, the toner replenishment device 20 is provided in a right side portion of the apparatus main body 2. The toner replenishment device 20 includes four toner containers 22 configured to store toners (developers) of four colors (yellow, magenta, cyan and black). The toner is a two-component developer; however, the toner is not limited thereto and may be a one-component developer containing a magnetic toner.

As shown in FIG. 2, the image forming device 6 includes an intermediate transferring belt 11, four drum units 12 and an optical scanning device 13. The intermediate transferring belt 11 is rotated in a direction indicated by an arrow in FIG. 2. Each drum unit 12 includes a photosensitive drum 14, a charging device 15, a development device 16, a primary transfer roller 17 and a cleaning device 18. Each primary transfer roller 17 is provided such that the intermediate transferring belt 11 is put between the photosensitive drum 14 and the primary transfer roller 17. With a rear portion of the intermediate transferring belt 11, a secondary transfer roller 19 comes into contact to form a transfer nip.

A controller (not shown) of the color printer 1 controls each device suitably to carry out an image forming operation as follows. The charging device 15 charges a surface of the photosensitive drum 14. The photosensitive drum 14 receives a scanning light emitted from the optical scanning device 13 to carry an electrostatic latent image. The development device 16 uses the toner supplied from the toner container 22 and develops the electrostatic latent image on the photosensitive drum 14 into a toner image. The primary transfer roller 17 primarily transfers the toner image on the photosensitive drum 14 to the rotating intermediate transferring belt 11. The intermediate transferring belt 11 carries a full color toner image formed by superimposing the four color toner images while rotating. The sheet S is fed by the sheet feeding device 5 from the sheet feeding cassette 3 to the conveyance path 8. The secondary transfer roller 19 secondarily transfers the toner image on the intermediate transferring belt 11 to the sheet S passing through the transfer nip. The fixing device 7 thermally fixes the toner image on the sheet S. After that, the sheet S is discharged on the discharge tray 4. The cleaning device 18 removes the toner remaining on the photosensitive drum 14.

Figure 3:
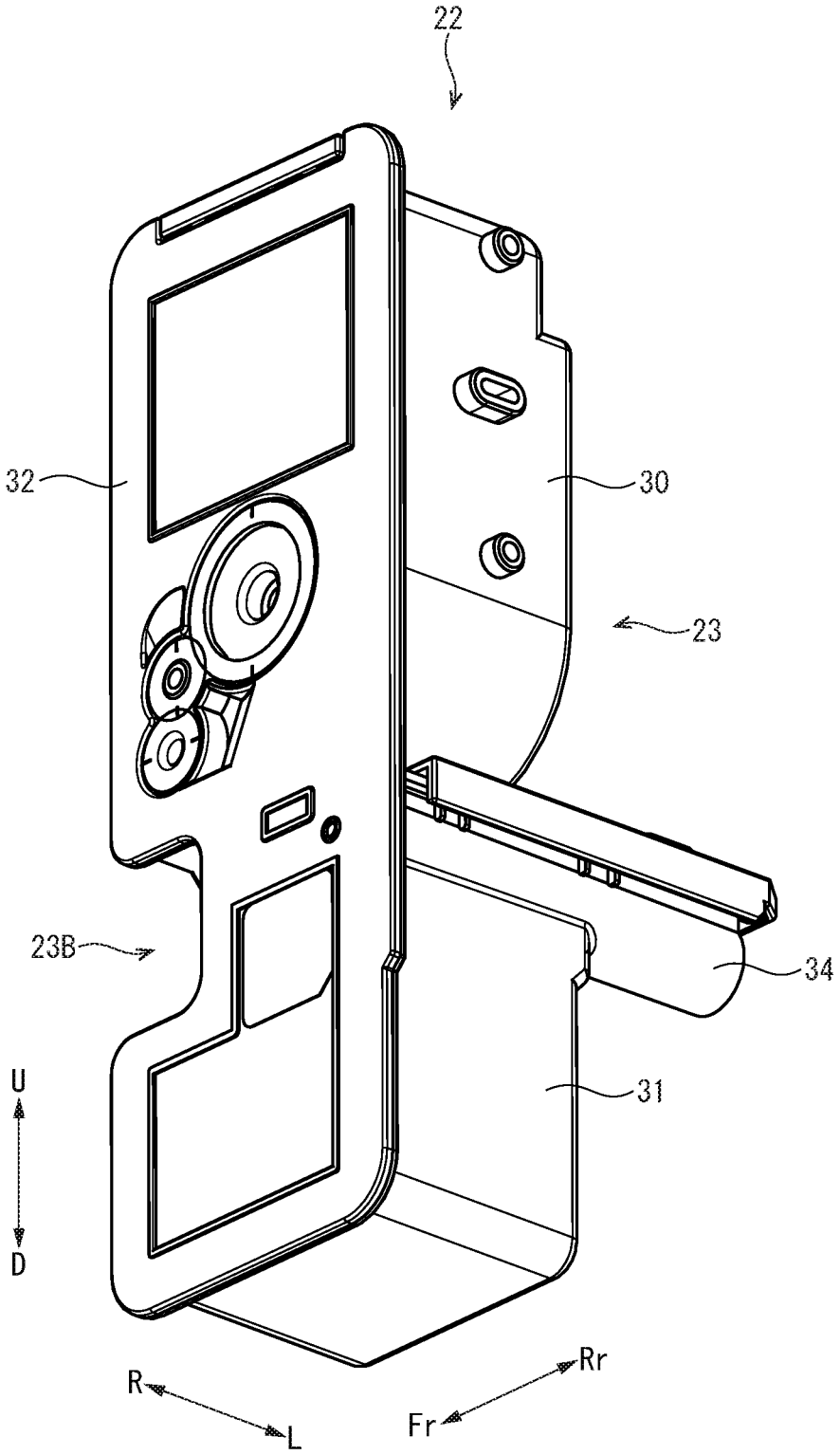
FIG. 3 is a perspective view showing a lid body side portion of a toner container according to a first embodiment of the present disclosure.
Figure 4:
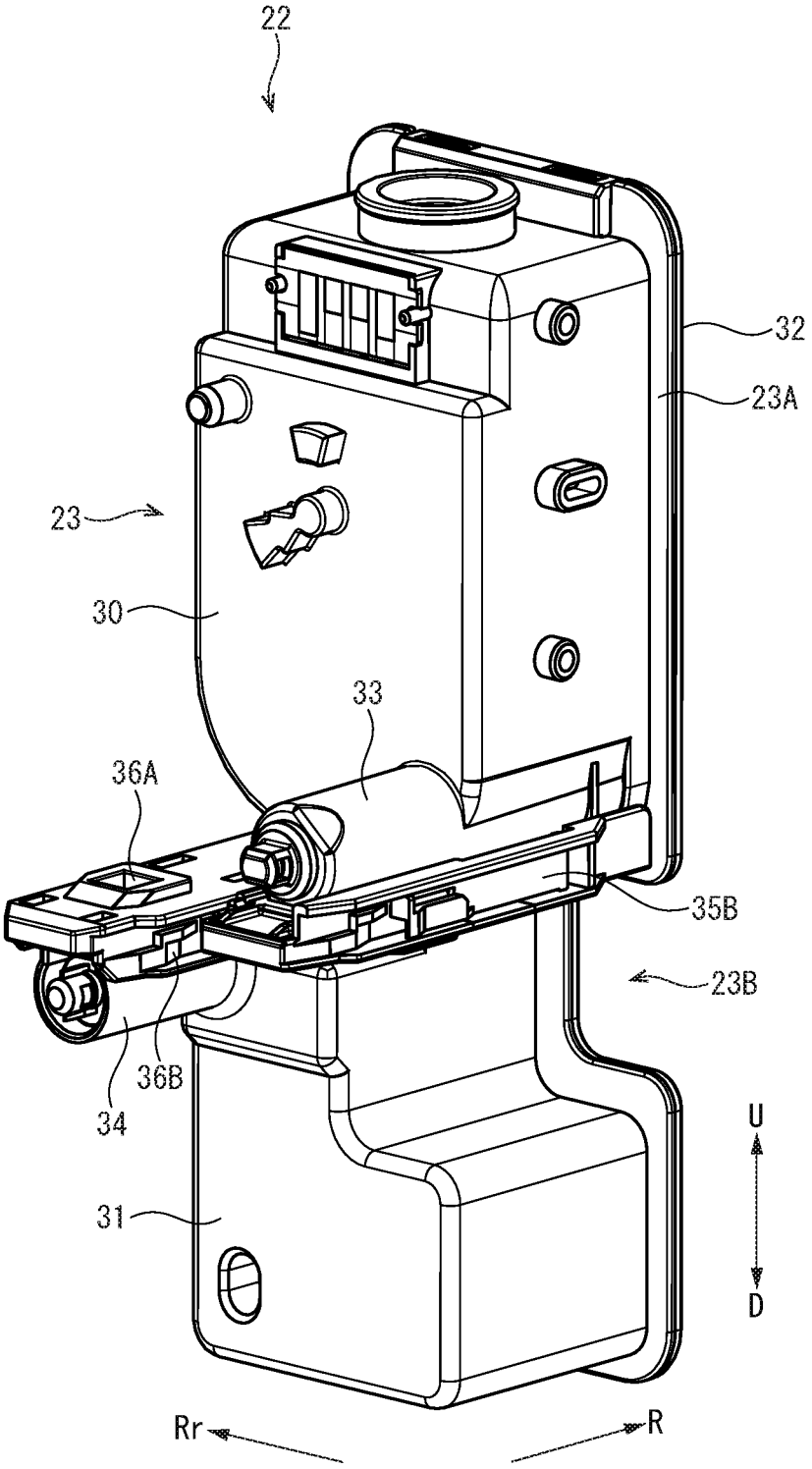
FIG. 4 is a perspective view showing a case side portion of the toner container according to the first embodiment of the present disclosure.
Figure 5:
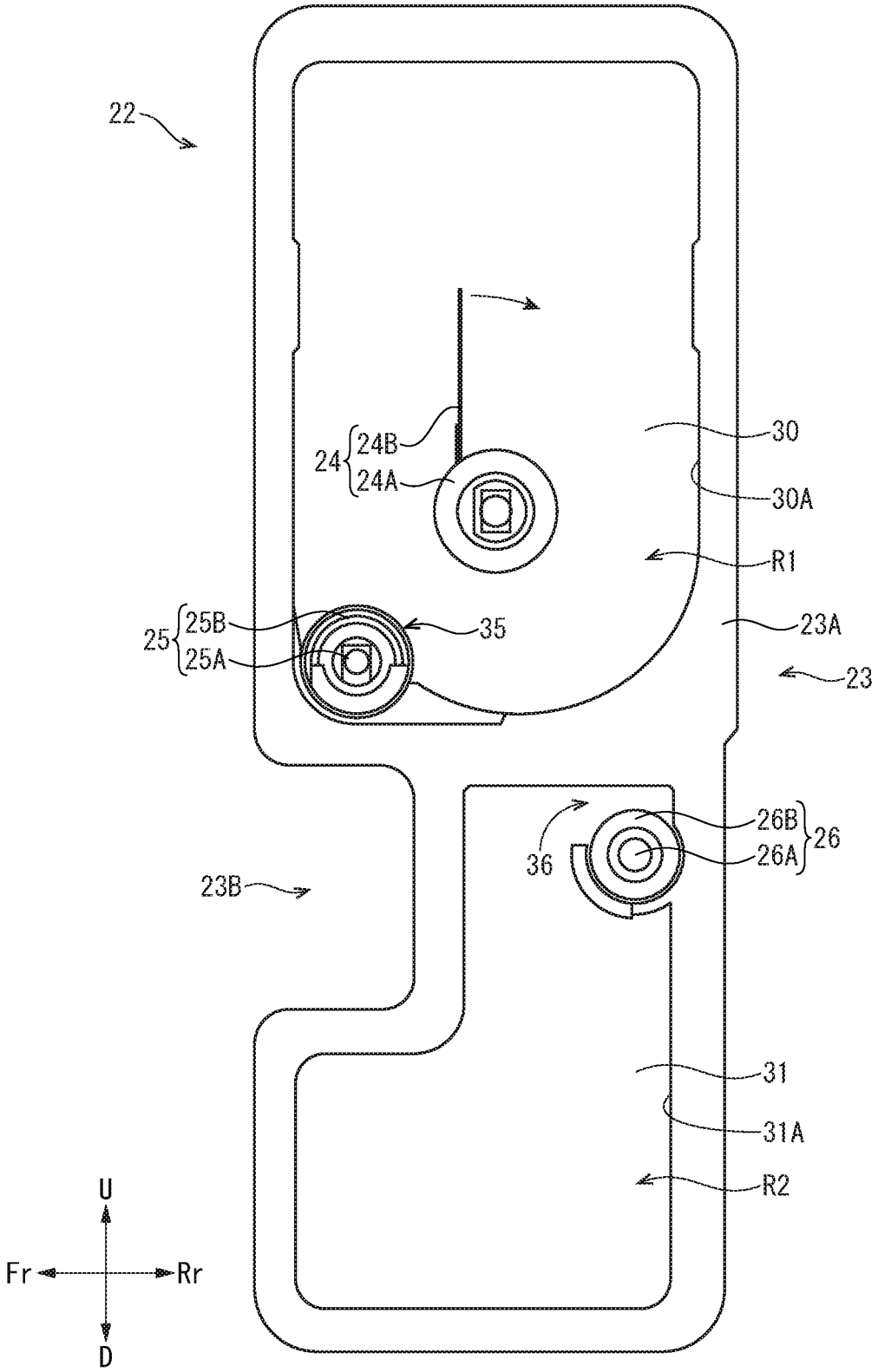
FIG. 5 is a side view showing an inside of the toner container according to the first embodiment of the first present disclosure.
Figure 6:
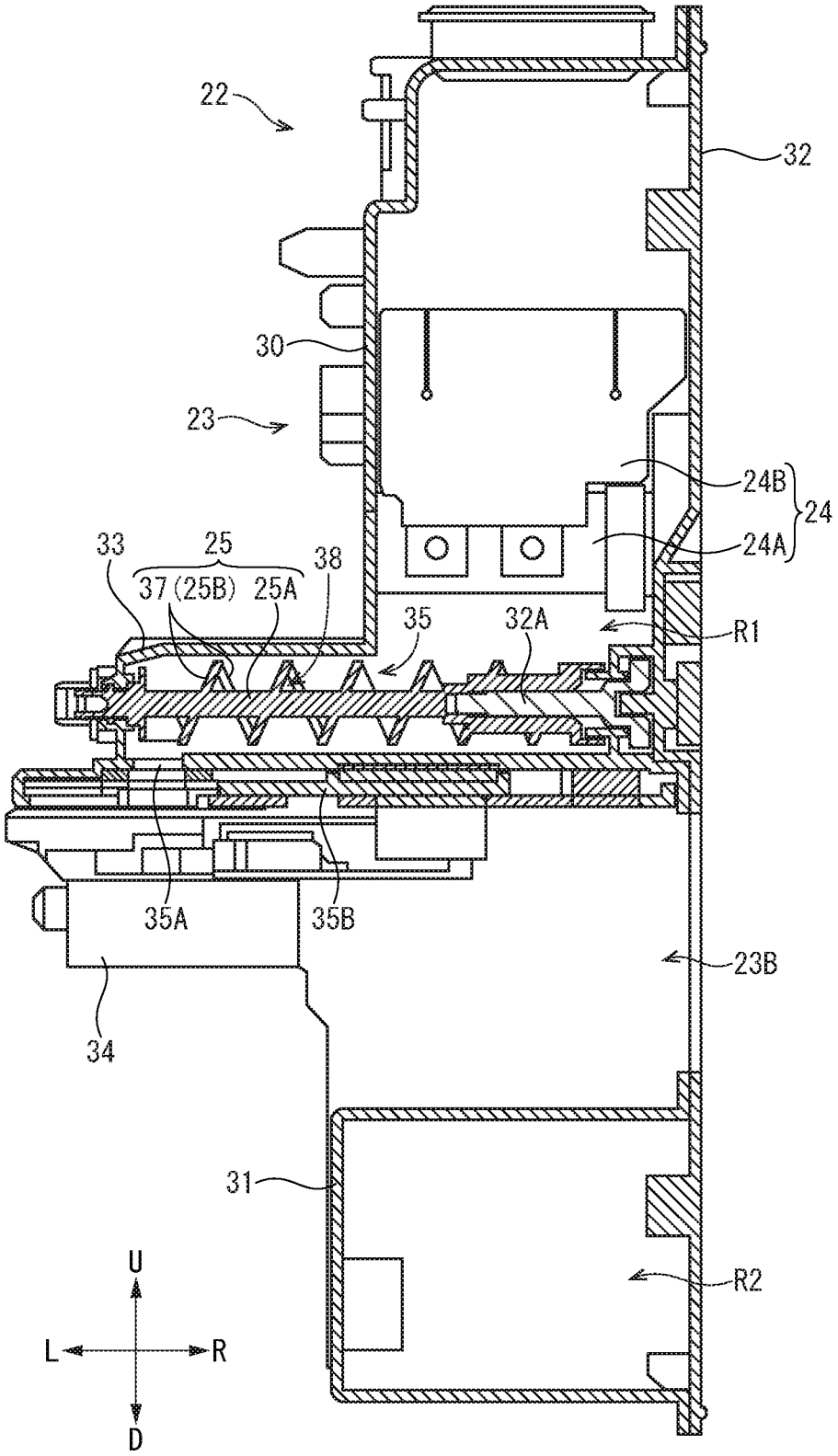
FIG. 6 is a sectional view showing the toner container according to the first embodiment of the first present disclosure.
Figure 7:
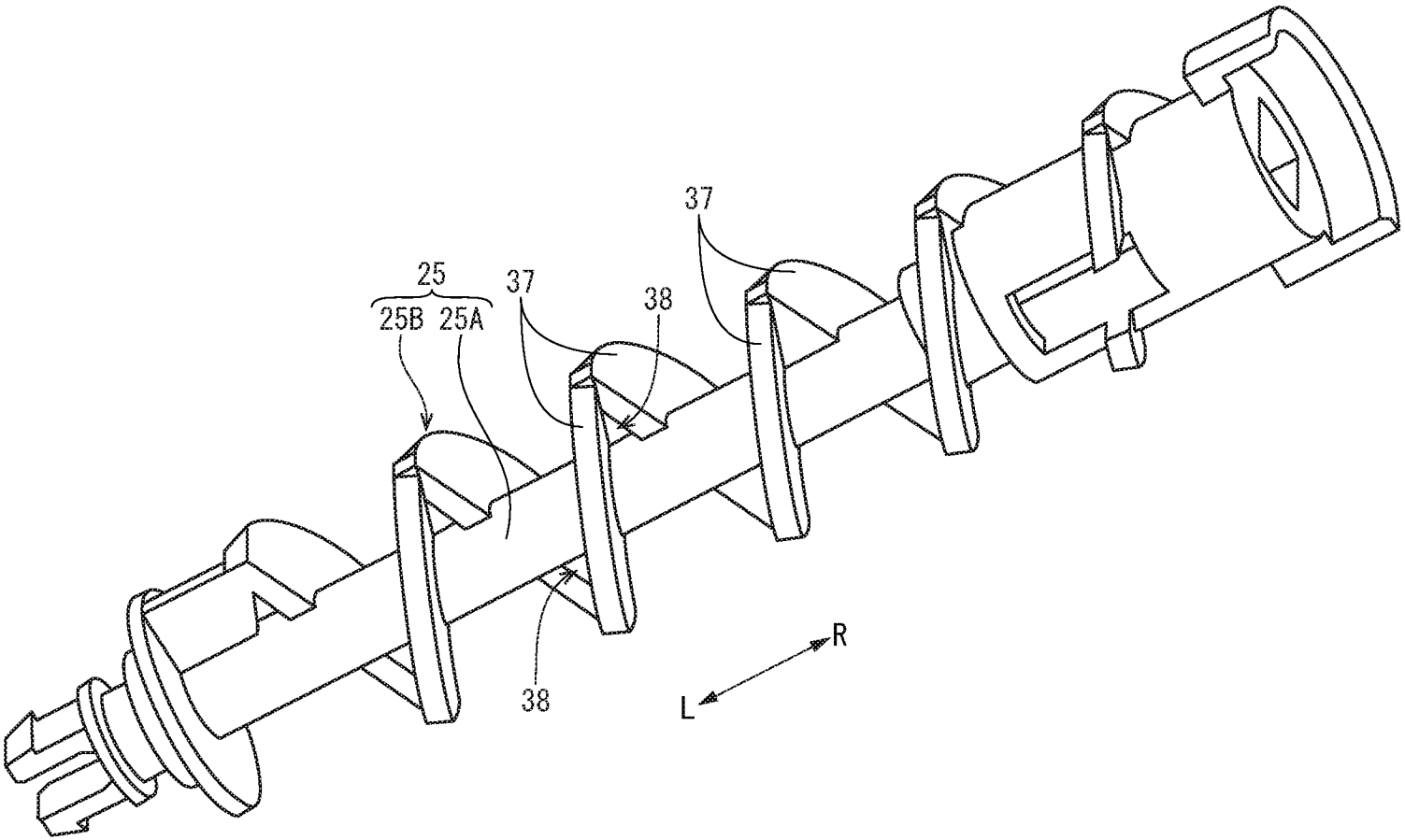
FIG. 7 is a perspective view showing a conveying screw according to the first embodiment of the present disclosure.

[The toner replenishment device] Next, with reference to FIG. 1, FIG. 3 to FIG. 7, the toner replenishment device 20 will be described. FIG. 3 is a perspective view showing a lid body 32 side portion of the toner container 22. FIG. 4 is a perspective view showing a cases 30 and 31 side portion of the toner container 22. FIG. 5 is a side view showing an inside of the toner container 22. FIG. 6 is a sectional view showing the toner container 22. FIG. 7 is a perspective view showing a conveying screw 25. In the following description, "a conveyance direction" shows a conveyance direction of the toner.

As shown in FIG. 1, the toner replenishment device 20 includes a container attachment part 21 and the four toner containers 22.

[The container attachment part] The container attachment part 21 is provided in the right side portion of the apparatus main body 2. In the container attachment part 21, four attachment rooms (not shown) are formed side by side in the front-and-rear direction. To the four attachment rooms, the four toner containers 22 are detachably attached. The apparatus main body 2 is provided with a cover 21A configured to open and close the container attachment part 21.

[The toner container] As shown in FIG. 3 to FIG. 5, the four toner containers 22 each includes a container main body 23, an agitating member 24, a conveying screw 25 and a collecting screw 26. The container main body 23 stores the toner. The agitating member 24 has a function to agitate the toner stored in the container main body 23. The conveying screw 25 has a function to convey the toner stored in the container main body 23 in an axial direction. The collecting screw 26 has a function to convey the toner to an inside of the container main body 23 in an axial direction.

As shown in FIG. 1, the toner container 22 storing the black color toner has a size larger than the toner containers 22 storing the toners other than the black color toner, and is attached to the rearmost attachment room. The four toner containers 22 have almost the same structure other than the size; the toner container 22 storing the toner other than the black color toner will be described hereinafter. In the following description, a state where the toner container 22 is attached to the container attachment part 21 (the attachment room) is set to be a reference state.

<The container main body> As shown in FIG. 3 to FIG. 5, the container main body 23 is formed in a box shape extending in the upper-and-lower direction (the longitudinal direction) and having a size shorter in the left-and-right direction (a depth direction perpendicular to the longitudinal direction) than in the upper-and-lower direction. A width of the container main body 23 in the front-and-rear direction is set to be shorter than a length (a height) in the upper-and-lower direction and longer than a length in the left-and-right direction (a depth of each of cases 30 and 31 described later).

The container main body 23 includes an upper part case 30 (a case) formed at an upper side, a lower part case 31 formed at a lower side, a lid body 32, a conveyance guide part 33 and a collection guide part 34.

(The upper part case, the lower part case) The upper part case 30 and the lower part case 31 are made of synthetic resin material and formed integrally, for example. The upper part case 30 and the lower part case 31 are formed in a box shape respectively having openings 30A and 31A at their right side faces (refer to FIG. 5). Around outer circumferential edges of the openings 30A and 31A of the cases 30 and 31, a flange part 23A is formed. Between the upper part case 30 and the lower part case 31, a recess part 23B recessing in an approximately rectangular shape from the front side to the rear side is formed.

As shown in FIG. 5 and FIG. 6, inside the upper part case 30, a storage chamber R1 configured to store a fresh toner is formed. Inside the lower part case 31, a collection chamber R2 configured to store a waste toner is formed. The storage chamber R1 and the collection chamber R2 have approximately parallelepiped spaces. A bottom face of the storage chamber R1 is formed in an approximately arc shape.

(The lid body) As shown in FIG. 3, the lid body 32 is made of synthetic resin and formed in an approximately flat plate shape, for example. The lid body 32 is formed in a shape corresponding to an outer circumferential shape of the flange part 23A. The lid body 32 is fixed to the flange part 23A to close the upper and lower openings 30A and 31A (refer to FIG. 6).

(The conveyance guide part) As shown in FIG. 4 to FIG. 6, the conveyance guide part 33 is formed in a cylindrical shape extending from the upper part case 30 in the left direction (the downstream side in the conveyance direction). In detail, the conveyance guide part 33 is formed integrally with a left side wall of the upper part case 30 near a front lower corner of the upper part case 30. A length (a depth) of the conveyance guide part 33 in the left-and-right direction is set to be shorter than a height of an entire portion of the container main body 23. A depth of both the conveyance guide part 33 and the upper part case 30 is set to be shorter than the height of the entire portion of the container main body 23 and to be longer than a width of the entire portion of the container main body 23 in the front-and-rear direction. Inside the conveyance guide part 33, a replenishment path 35 configured to communicate the storage chamber R1 with the development device 16 (an example of a destination of the toner) is formed (refer to FIG. 6). A cross sectional area of the conveyance guide part 33 (the replenishment path 35) is set to be sufficiently smaller than an area of the storage chamber R1 when the storage chamber R1 is viewed from the lateral side (refer to FIG. 5).

As shown in FIG. 6, on a tip side lower face of the conveyance guide part 33, a discharge port 35A through which the toner is discharged to the development device 16 is formed. On the tip side lower face of the conveyance guide part 33, a discharge shutter 35B which opens and closes the discharge port 35A is formed in a slidable manner. The discharge shutter 35B is moved from a position where the discharge shutter 35B closes the discharge port 35A to a position where the discharge shutter 35B opens the discharge port 35A during a process where the toner container 22 is attached to the container attachment part 21. FIG. 6 shows the discharge shutter 35B moved to the position where the discharge shutter 35B opens the discharge port 35A.

(The collection guide part) As shown in FIG. 3 to FIG. 5, the collection guide part 34 is formed in a cylindrical shape extending from the lower part case 31 in the left direction. In detail, the collection guide part 34 is formed integrally with a left side wall of the lower part case 31 near a rear upper corner of the lower part case 31. The collection guide part 34 is disposed below the conveyance guide part 33 and has almost the same length as the conveyance guide part 33. Inside the collection guide part 34, a collection path 36 configured to communicate the collection chamber R2 with the cleaning device 18 is formed (refer to FIG. 5).

As shown in FIG. 4, on a tip side upper face of the collection guide part 34, an introduction port 36A through which the toner is introduced in the collection path 36 is formed. On the tip side upper face of the collection guide part 34, an introduction shutter 36B which opens and closes the introduction port 36A is provided in a slidable manner. The introduction shutter 36B is moved from a position where the introduction shutter 36B closes the introduction port 36A to a position where the introduction shutter 36B opens the introduction port 36A during the process where the toner container 22 is attached to the container attachment part 21.

<The agitating member> As shown in FIG. 5 and FIG. 6, the agitating member 24 is disposed inside the storage chamber R1 in a posture extending in the left-and-right direction. The agitating member 24 includes an agitating shaft part 24A and a paddle part 24B.

The agitating shaft part 24A is made of synthetic resin and formed in a rod shape extending in the left-and-right direction, for example. One axial end portion of the agitating shaft part 24A is supported by the left side wall of the upper part case 30 in a rotatable manner and the other axial end portion of the agitating shaft part 24A is supported by the lid body 32 in a rotatable manner. The paddle part 24B is formed by elastically deformable film material made of synthetic resin. The paddle part 24B is provided in a state extending outwardly in a radial direction from the agitating shaft part 24A. The paddle part 24B is formed so as to have a length enough that a tip end portion of the paddle part 24B comes into contact with the bottom face of the storage chamber R1.

<The conveying screw> As shown in FIG. 5 and FIG. 6, the conveying screw 25 is disposed over the storage chamber R1 and the replenishment path 35 in a posture extending in the left-and-right direction. The conveying screw 25 is provided in a posture where its axial direction extends in the left-and-right direction (the depth direction of the container main body 23). Specifically, the conveying screw 25 has an axial length corresponding to a length of both the storage chamber R1 and the replenishment path 35 in the left-and-right direction and shorter than the height of the entire portion of the container main body 23. The conveying screw 25 is disposed on almost the same axis as the replenishment path 35 when viewed form the lateral side.

As shown in FIG. 5 to FIG. 7, the conveying screw 25 includes a conveying shaft part 25A and a conveying blade 25B. The conveying shaft part 25A and the conveying blade 25B are made of synthetic resin and formed integrally, for example.

As shown in FIG. 6, the conveying shaft part 25A is formed in a rod shape extending in the left-and-right direction. A left end portion of the conveying shaft part 25A in an axial direction is supported by a left end portion of the conveyance guide part 33. A right end portion of the conveying shaft part 25A in the axial direction is fixed to a turnable supporting shaft 32A provided in the lid body 32 in a turnable manner.

As shown in FIG. 6 and FIG. 7, the conveying blade 25B is spirally formed around an outer circumferential face of the conveying shaft part 25A. The conveying blade 25B is formed around the outer circumferential face of the conveying shaft part 25A for five to five and half spirals while being shifted in the axial direction. The conveying blade 25B has an outer diameter in such a degree that the conveying blade 25B does not come into contact with an inner circumferential face of the conveyance guide part 33. The conveying blade 25B will be described later.

<The collecting screw> As shown in FIG. 5, the collecting screw 26 is disposed in the collection path 36 in a posture extending in the left-and-right direction. The collecting screw 26 includes a collecting shaft part 26A and a collecting blade 26B formed spirally around an outer circumferential face of the collecting shaft part 26A. The collecting shaft part 26A and the collecting blade 26B are made of synthetic resin and formed integrally, for example. An outer shape of the collecting screw 26 has almost the same shape as the conveying screw 25 and the collecting blade 26B has a conventional spiral shape formed by a continuous curve, and the description of the collecting screw 26 is omitted.

[A conveying operation for the toner in the toner container] For example, when a user attaches the toner container 22 to the container attachment part 21, the discharge shutter 35B is opened to communicate the discharge port 35A with a toner introduction part (not shown) of the development device 16. At the same time, the introduction shutter 36B is opened to communicate the introduction port 36A with a toner discharge port (not shown) of the cleaning device 18. Furthermore, at the same time, the agitating shaft part 24A, the conveying shaft part 25A and the collecting shaft part 26A are connected to a motor (not shown) via a joint member and a gear train.

When the above described image forming operation is started, the motor rotates the agitating member 24, the conveying screw 25 and the collecting screw 26 around their axes. The paddle part 24B of the agitating member 24 rotates while coming into contact with the bottom face and the others of the storage chamber R1 to agitate the toner stored in the storage chamber R1. The conveying blade 25B of the conveying screw 25 conveys the toner stored in the storage chamber R1 to the downstream side in the replenishment path 35. The toner is conveyed along the replenishment path 35 and replenished through the discharge port 35A to the development device 16. The development device 16 uses the replenished toner and develops the electrostatic latent image on the photosensitive drum 14 into the toner image.

The toner remaining on the photosensitive drum 14 after the toner is transferred is removed by the cleaning device 18. The removed toner is taken into the collection path 36 from the toner discharge part of the cleaning device 18 through the introduction port 36A. The collecting blade 26B of the collecting screw 26 conveys the toner taken into the collection path 36 toward the collection chamber R2. The toner is conveyed along the collection path 36 and then stored in the collection chamber R2.

An amount of the toner replenished in the development device 16 is detected by a sensor (not shown), and the controller recognizes a residual amount of the toner in the storage chamber R1 from a detection result of the sensor. When it is recognized that the residual amount of the toner is less than a predetermined amount (or equal to zero), the controller may display an information to prompt a replacement of the toner container 22 on a liquid crystal display (not shown) of the color printer 1 or order a new toner container 22 through an Internet.

By the way, when the residual amount of the toner is large, a sufficient amount of the toner exists around the conveying screw 25 and a sufficient amount of the toner agitated by the agitating member 24 is supplied around the conveying screw 25. Thereby, the conveying screw 25 can convey an approximately constant amount of the toner so that it becomes possible to make a replenish amount (a supply amount) of the toner to the development device 16 stable. On the other hand, when the residual amount of the toner is small, because an amount of the toner agitated by the agitating member 24 is decreased, it becomes impossible to supply a sufficient amount of the toner around the conveying screw 25. In this case, a ratio of the toner to the void between the axially adjacent portions of the conveying blade 25B may be increased or decreased and may become unstable. Thereby, an amount of the toner conveyed by the conveying screw 25 (the replenish amount of the toner to the development device 16) becomes unstable. Then, even if the toner remains in the storage chamber R1, the controller may misrecognize that an amount of the residual toner is less than the predetermined amount. As a result, the toner container 22 which does not require to be replaced may be replaced.

Then, in the conveying screw 25 according to the first embodiment, the conveying blade 25B is formed so as to convey the toner while compressing the toner in the replenishment path 35. Specifically, as shown in FIG. 6, the toner in the storage chamber R1 is applied with a conveying force by the rotating conveying blade 25B and conveyed to the downstream side in the conveyance direction while a part of the toner is released outwardly in the radial direction. When the toner enters the replenishment path 35 from the storage chamber R1, the toner is blocked by the conveyance guide part 33 and is eliminated from being released outward in the radial direction so that a compressing force applied on the toner from the conveying blade 25B is suddenly increased.

As described above, the toner container 22 according to the first embodiment is configured such that the compressing force applied on the toner from the conveying blade 25B is increased as the toner enters the replenishment path 35 from the storage chamber R1. According to the configuration, because the toner is conveyed through the replenishment path 35 while being compressed, even if the residual amount of the toner in the storage chamber R1 is small, it becomes possible to prevent the occurrence of the void in the replenishment path 35. As a result, regardless of the residual amount of the toner in the storage chamber R1, it becomes possible to make the replenishment amount of the toner to the development device 16 stable.

When the conveying blade 25B conveys the toner while compressing the toner in the replenishment path 35 as described above, the toner may be excessively compressed and be solidified. The solidification of the toner becomes apparent when a capsule toner susceptible to be compressed and a toner having a low melting point are used. Then, the conveying screw 25 according to the first embodiment includes the conveying blade 25B configured to suppress the excessive compressing of the toner.

[A structure of the conveying blade] Next, with reference to FIG. 6 and FIG. 7, a structure of the conveying blade 25B will be described.

The conveying blade 25B is formed by a plurality of blade plates 37, and the blade plates 37 are spirally coupled across the conveying shaft part 25A alternately. The blade plates 37 are arranged at approximately equal intervals in the axial direction. That is, the spirals of the conveying blade 25B are shifted with a uniform pitch in the axial direction. One spiral of the conveying blade 25B is formed by the two blade plates 37. The blade plate 37 is formed in an approximately semicircular plate shape. The two blade plates 37 are coupled in postures inclined in the opposite directions to each other. In detail, the two blade plate 37 are coupled in the postures inclined in the opposite directions to each other such that a portion near a center of a chord circumferential portion between circumferential ends of the semicircular circumferential portion of the blade plate 37 is fixed to the conveying shaft part 25A and one end portions of the chord circumferential portions of the two blade plates 37 are coupled together. Note that the semicircular shape of the blade plate 37 does not require a complete semicircular shape and a small difference is allowable. That is, the blade plate 37 may be an arc shape other than the semicircular shape. For example, the blade plate 37 may be formed by coupling an arc shaped blade plate 37 having a central angle of 180° or larger and an arc shaped blade plate 37 having a central angle of less than 180° (not shown).

As shown in FIG. 6, the conveying blade 25B disposed in the replenishment path 35 has through holes 38 through which the toner is passed in the axial direction. As shown in FIG. 7, the though hole 38 is formed in an area surrounded by the conveying shaft part 25A and the two blade plates 37. The through hole 38 is a triangular hole with a ridge line of the conveying shaft part 25A as a bottom line and the chord circumferential portions of the two blade plates 37 as inclined lines. The conveying blade 25B disposed other than the replenishment path 35 (the conveying blade 25B disposed in the storage chamber R1) does not have the through hole 38 and the portions corresponding to the through holes 38 are filled up (refer to FIG. 7).

According to the conveying screw 25 according to the first embodiment as described above, in the replenishment path 35 where the toner may be excessively compressed, the conveying blade 25B is formed by the blade plates 37 which form the through hole 38 with the conveying shaft part 25A. According to the configuration, because the toner conveyed along replenishment path 35 while being compressed can be released through the through holes 38 to the upstream side in the conveyance direction, it becomes possible to suppress the toner conveyed along the replenishment path 35 from being excessively compressed. This makes it possible to suppress the solidification of the toner owing to the excessive compressing.

According to the conveying screw 25 (the toner container 22) of the first embodiment, it becomes possible to obtain both counter effects where one effect is to supply the toner stably by conveying the toner while compressing and the other effect is to prevent the excessive compressing of the toner.

In the toner container 22 according to the first embodiment, the conveying screw 25 is formed to have the short axial length to correspond to the depth of the container main body 23 (the conveyance guide part 33). In this case, the compressing force of the toner is suddenly changed in a narrow space in the axial direction. However, because the conveying screw 25 makes it possible to release the toner through the through hole 38 to the upstream side in the conveyance direction, even if the conveying screw 25 has the short axial length, it becomes possible to prevent the excessive compressing of the toner.

In the conveying screw 25 of the first embodiment, an entire portion of the conveying blade 25B disposed in the replenishment path 35 is formed by the blade plates 37 which form the through hole 38 with the conveying shaft part 25A; however, the present disclosure is not limited thereto. A part of the conveying blade 25B disposed in the replenishment path 35 may be formed by the blade plates 37 which form the through hole 38 with the conveying shaft part 25A. Alternatively, the entire portion of the conveying blade 25B disposed in the replenishment path 35 and a part of the conveying blade 25B disposed in the storage chamber R1 may be formed by the blade plates 37 which form the through hole 38 with the conveying shaft part 25A. Additionally, the entire portion of the conveying blade 25B may be formed by the blade plates 37 which form the through hole 38 with the conveying shaft part 25A.

Figure 8:
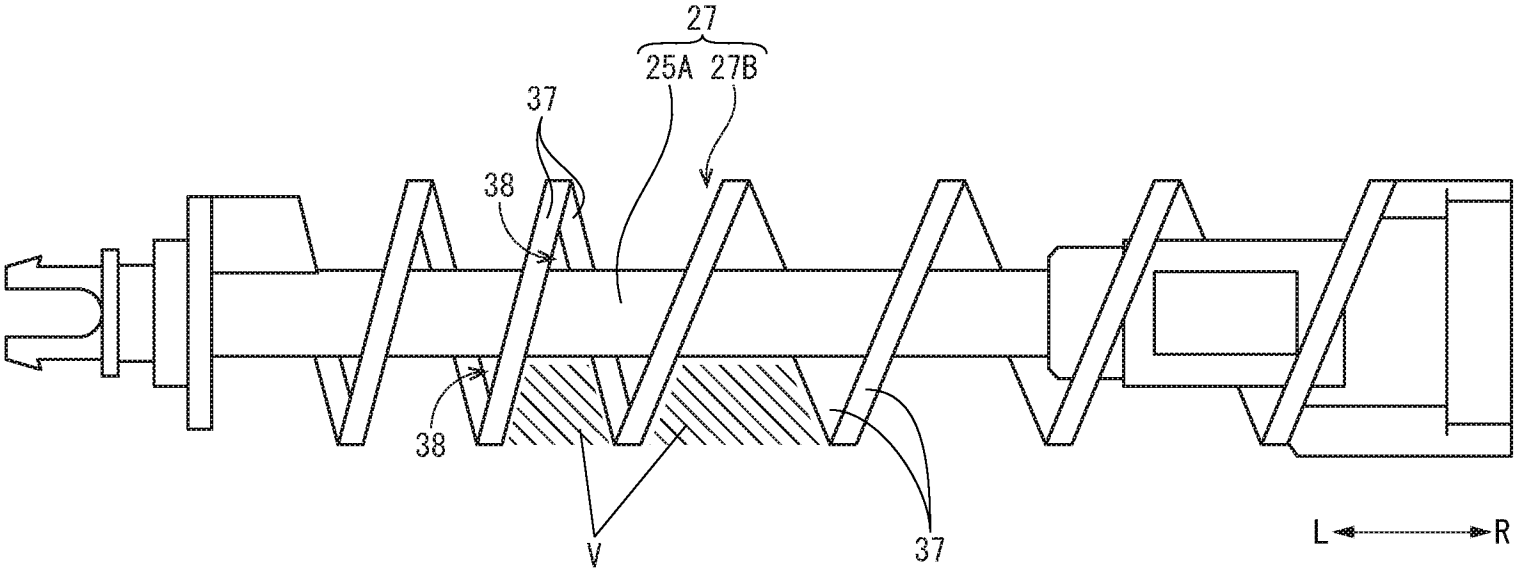
FIG. 8 is a front view showing the conveying screw according to a second embodiment of the present disclosure.
Figure 9:
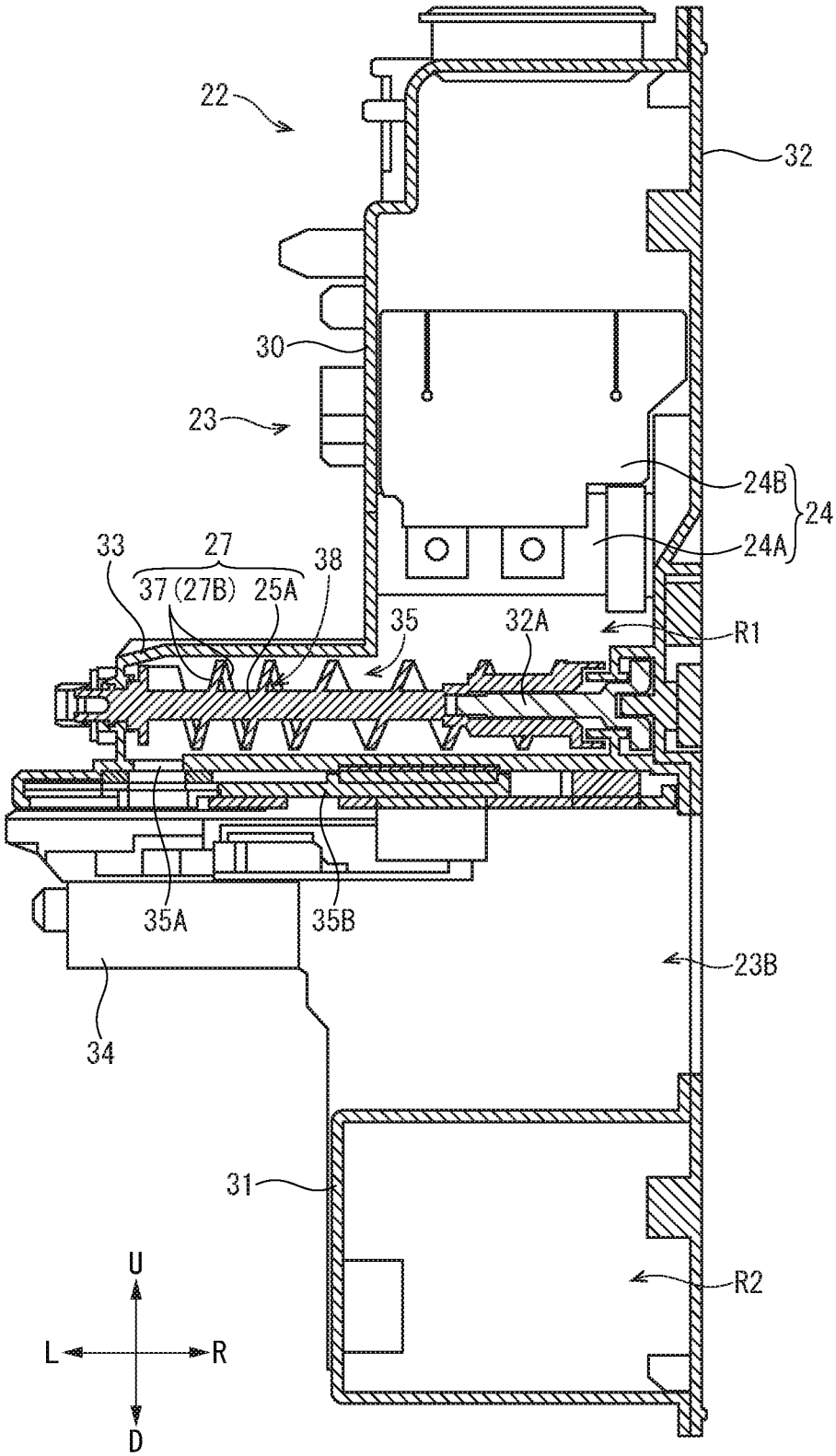
FIG. 9 is a sectional view showing the toner container including the conveying screw according to the second embodiment of the present disclosure.

[A second embodiment] Next, with reference to FIG. 8 and FIG. 9, the conveying screw 27 according to a second embodiment will be described. FIG. 8 is a front view showing the conveying screw 27. FIG. 9 is a sectional view showing the toner container 22 including the conveying screw 27. In the following description, the same structures as the toner container 22, the conveying screw 25 and the others in the first embodiment are shown by the same reference numbers as the first embodiment, and their detail descriptions are omitted.

In the conveying screw 25 according to the first embodiment, the pitch of the conveying blade 25B (the blade plate 37) is formed at approximately uniform intervals. However, when the residual amount of the toner is small, a change in ratio of the toner to the void between the axially adjacent portions of the conveying blade 25B becomes large toward the downstream side in the conveyance direction. Thereby, in order to make an amount of the toner conveyed by the conveying screw 25 stable, it may be said that it is effective to increase the compressing force of the toner at the downstream side in the conveyance direction. Then, in the conveying screw 27 according to the second embodiment, the conveying blade 27B has a configuration which delays the toner conveyance at the downstream side in the conveyance direction.

As shown in FIG. 8, the conveying screw 27 is formed such that the pitch of the conveying blade 25B is gradually narrowed from the upstream side to the downstream side in the conveyance direction. In other words, the conveying blade 27B is formed such that a volume V between the axially adjacent portions of the conveying blade 27B is gradually decreased from the upstream side to the downstream side in the conveyance direction. For example, as shown in FIG. 8 and FIG. 9, the conveying screw 27 is formed such that, of the conveying blade 27B disposed in the replenishment path 35, a gap between the blade plates 37 forming the two to two and half spirals at the downstream side is made to be narrower than a gap between the blade plates 37 forming the other spirals. This makes it possible to increase the compressing force of the toner at the downstream side in the conveyance direction and it becomes possible to make the amount of the toner conveyed by the conveying screw 27 stable regardless of the residual amount of the toner.

As shown in FIG. 8 and FIG. 9, the blade plates 37 of which the gap is made to be narrow form the through hole 38 with the conveying shaft part 25A while the other blade plates 37 do not form the through hole 38 with the conveying shaft part 25A. According to the configuration, because the conveying blade 27B has the through hole 38 in an area where the compressing force of the toner becomes high, it becomes possible to release the toner to the upstream side in the conveyance direction. Then, even if the conveying screw 27 has a short axial length, it becomes possible to suppress the excessive compressing of the toner.

The through hole 38 may be formed by a part of the blade plates 37 other than the blade plates 37 of which the gap is made to be narrow, or may be formed by all of the blade plates 37. That is, the conveying blade 27B may be formed by the blade plates 37 which form the through hole 38 with the conveying shaft part 25A at the downstream side in the conveyance direction from a position where the volume V between the axially adjacent portions of the conveying blade 27B is smaller than a set value. The set value of the volume V may be set such that the solidification of the toner does not occur in view of the type and the melting point of the toner.

In the conveying screw 27 according to the second embodiment, the conveying blade 27B (the blade plate 37) is formed to have the two different pitches and the pitch is changed for one step (one time). However, the present disclosure is not limited thereto. For example, the conveying blade 27B (the blade plate 37) may be formed to have three or more different pitches and the pitch may be changed for two or more steps (two or more times) (not shown). In a case where the conveying blade 27B (the blade plate 37) is formed to have three or more different pitches, the through hole 38 may be formed only by the blade plate 37 of the most narrow gap (pitch) or may be formed by the blade plate 37 other than the blade plate 37 of the most wide pitch (not shown).

Figure 10:
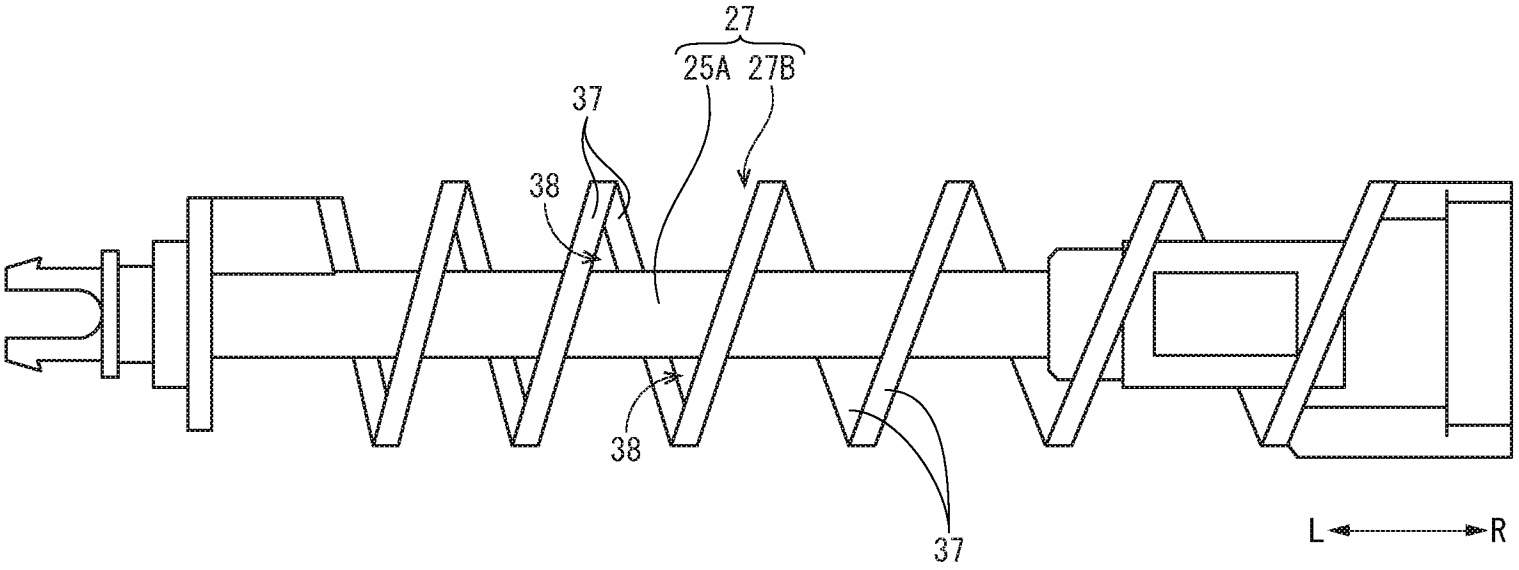
FIG. 10 is a front view showing the conveying screw according to a first modified example of the second embodiment of the present disclosure.

In the conveying screw 27 according to the second embodiment, the pitch of the conveying blade 27B is formed to be gradually narrowed from the upstream side to the downstream side in the conveyance direction. However, the present disclosure is not limited thereto. As the conveying screw 27 of a first modified example, as shown in FIG. 10, the pitch of the conveying blade 27B may be formed to be continuously narrowed from the upstream side to the downstream side in the conveyance direction. In other words, the conveying blade 27B may be formed such that the volume V between the axially adjacent portions of the conveying blade 27B is continuously decreased from the upstream side to the downstream side in the conveyance direction.

Figure 11:
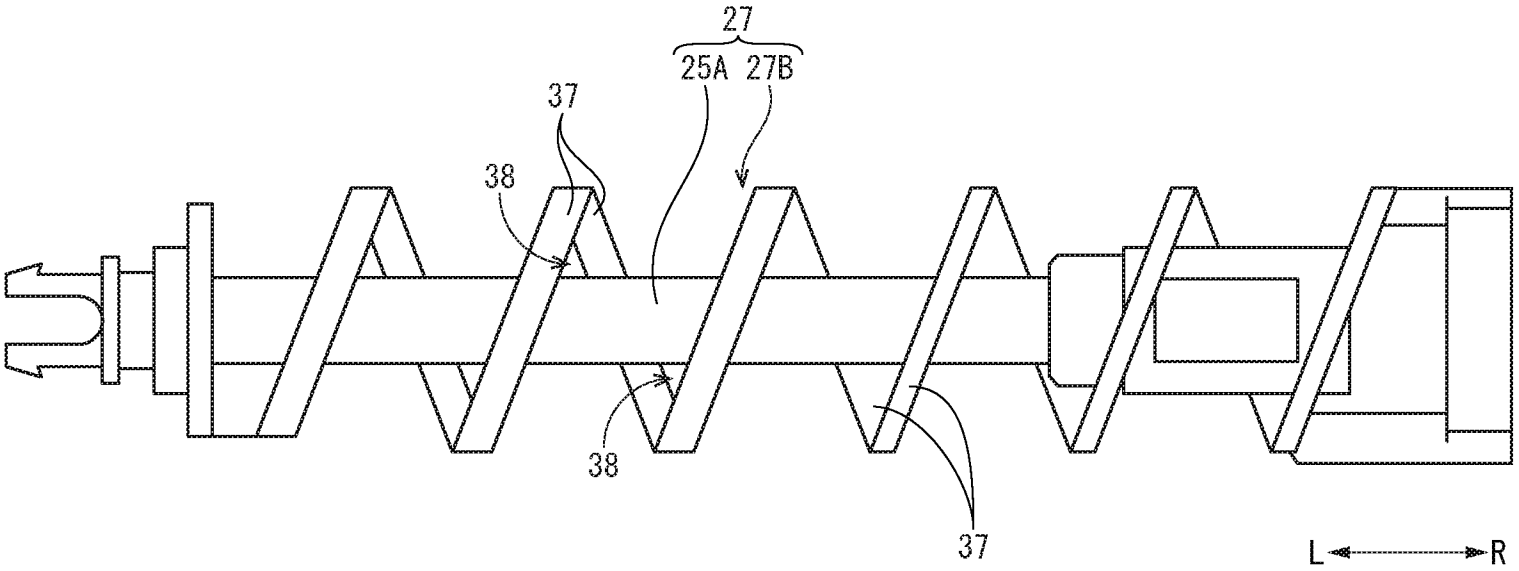
FIG. 11 is a front view showing the conveying screw according to a second modified example of the second embodiment of the present disclosure.

In the conveying screw 27 according to the second embodiment (including the first modified example), by changing the pitch of the conveying blade 27B, the volume V between the axially adjacent portions of the conveying blade 27B is changed. However, the present disclosure is not limited thereto. In the conveying screw 27 as a second modified example, as shown in FIG. 11, the pitch of the conveying blade 27B is uniform (equal intervals) while a thickness of the conveying blade 27B (the blade plate 37) in the axial direction is gradually increased from the upstream side to the downstream side in the conveyance direction to decrease the volume V gradually. In this case, it is preferable to form the through hole 38 by the blade plate 37 formed to have a thicker thickness. The thickness of the conveying blade 27B (the blade plate 37) in the axial direction may be continuously increased (not shown).

Figure 12:
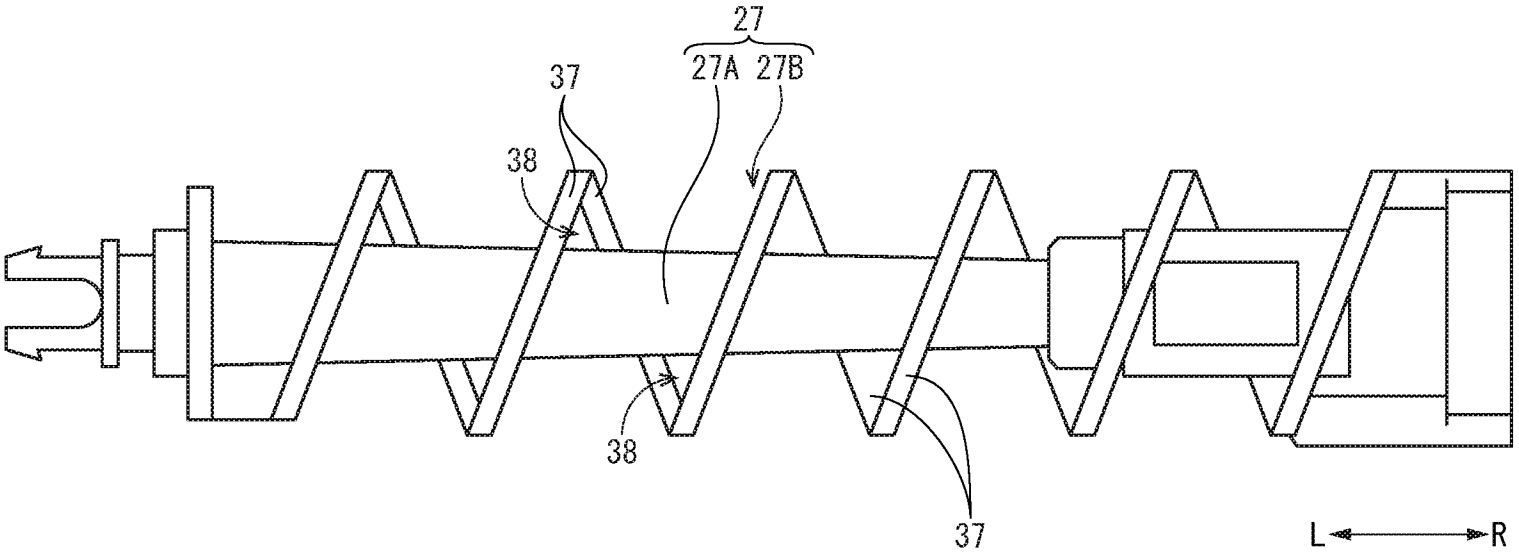
FIG. 12 is a front view showing the conveying screw according to a third modified example of the second embodiment of the present disclosure.

In the conveying screw 27 according to a third modified example, as shown in FIG. 12, the pitch of the conveying blade 27B is uniform (equal intervals) while an outer diameter (a diameter) of the conveying shaft part 27A is gradually increased from the upstream side to the downstream side in the conveyance direction to decrease the volume V gradually or continuously. Alternatively, the outer diameter (the diameter) of the conveying shaft part 27A may be gradually increased from the upstream side to the downstream side in the conveyance direction (not shown).

Alternatively, to the conveying screw 27 changed in the pitch of the conveying blade 27B, the conveying blade 27B (the blade plate 37) changed in the thickness and the conveying shaft part 27A changed in the diameter may be applied (not shown).

In the conveying screws 25 and 27 according to the first and second embodiments, the entire portions of the conveying blades 25B and 27B are formed by the blade plate 37. However, the present disclosure is not limited thereto. At least one spiral of the conveying blades 25B and 27B may be formed by two semicircular blade plates coupled in the posture inclined in the opposite directions to each other. For example, of the conveying blades 25B and 27B, a portion in a range where the through hole 38 is not required is not formed by the blade plate 37; may be a conventional spiral blade having no through hole 38 as the same as the collecting blade 26B of the collecting screw 26.

In the toner container 22 according to the first and second embodiments, the conveyance guide part 33 (the replenishment path 35) is formed to have almost the same cross area from the upstream side to the downstream side. The present disclosure is not limited thereto. For example, the conveyance guide part 33 (the replenishment path 35) may be formed to have a cross area gradually or continuously decreased from the upstream side to the downstream side (not shown).

In the toner container 22 according to the first and second embodiments, the collecting screw 26 includes the conventional spiral collecting blade 26B having no through hole 38. The present disclosure is not limited thereto. The collecting blade 26B may have the same feature as the conveying blades 25B and 27B of the conveying screws 25 and 27.

In the toner container 22 according to the first and second embodiments, the container main body 23 includes the upper part case 30 and the lower part case 31 which are separated, and the lower part case 31 has the collection chamber R2 configured to store the waste toner. The present disclosure is not limited thereto. The container main body 23 may not include the lower part case 31 (the collection chamber R2) (not shown).

The conveying screws 25 and 27 according to the first and second embodiments are equipped in the toner container 22. However, the present disclosure is not limited thereto. They may be equipped in the development device 16 and the cleaning device 18.

In the description of the present embodiment, a case where the present disclosure is applied to the color printer 1 is shown as an example. However, the present disclosure is not limited thereto; may be applied to a monochrome printer, a copying machine, a facsimile and a multifunctional peripheral.

The description of the above embodiments shows one aspect in the conveying screw, the toner container and the image forming apparatus according to the present disclosure, and the technical scope of the present disclosure is not limited the above described embodiments.

While the present disclosure has been described with reference to the particular illustrative embodiments, it is not to be restricted by the embodiments. It is to be appreciated that those skilled in the art can change or modify the embodiments without departing from the scope and spirit of the present disclosure.

The invention claimed is:

1. A conveying screw configured to convey a toner in an axial direction, the conveying screw comprising:

a conveying shaft part configured to be rotated around an axis; and a conveying blade spirally formed around an outer circumferential face of the conveying shaft part and configured to convey a toner in a replenishment path, wherein at least one spiral of the conveying blade is formed by two semicircular blade plates which are coupled to in postures inclined in opposite directions to each other, and a through hole through which the toner is passed in the axial direction is formed in an area surrounded by the conveying shaft part and the two blade plates, the conveying blade is formed such that a volume between axially adjacent portions of the conveying blade is continuously or gradually decreased from an upstream side to a downstream side in a conveyance direction of the toner, and the through hole is formed in the area surrounded by the conveying shaft part and the two blade plates of the conveying blade disposed at the downstream side in the conveyance direction from a position where the volume between the axially adjacent portions of the conveying blade is less than a set value.

2. The conveying screw according to claim 1, wherein the through hole is formed in the area surrounded by the conveying shaft part and the two blade plates of the conveying blade disposed in the replenishment path.

3. The conveying screw according to claim 1, wherein a pitch of the conveying blade is formed to be continuously or gradually narrowed from the upstream side to the downstream side in the conveyance direction.

4. The conveying screw according to claim 1, wherein a pitch of the conveying blade is uniform while a thickness of the conveying blade in the axial direction is formed to be continuously or gradually increased from the upstream side to the downstream side in the conveyance direction.

5. A toner container comprising:

a container main body configured to store a toner and to include a replenishment path communicated with a destination; and a conveying screw configured to convey the toner stored in the container main body in an axial direction, wherein the conveying screw includes:

a conveying shaft part configured to be rotated around an axis; and a conveying blade spirally formed around an outer circumferential face of the conveying shaft part and configured to convey the toner in the replenishment path, wherein at least one spiral of the conveying blade is formed by two semicircular blade plates which are coupled to in postures inclined in opposite directions to each other, and a through hole through which the toner is passed in the axial direction is formed in an area surrounded by the conveying shaft part and the two blade plates, the conveying blade is formed such that a volume between axially adjacent portions of the conveying blade is continuously or gradually decreased from an upstream side to a downstream side in a conveyance direction of the toner, and the through hole is formed in the area surrounded by the conveying shaft part and the two blade plates of the conveying blade disposed at the downstream side in the conveyance direction from a position where the volume between the axially adjacent portions of the conveyance blade is less than a set value.

6. The toner container according to claim 5, wherein the container main body includes:

a case configured to form a storage chamber for the toner; and a conveyance guide part formed in a cylindrical shape extending from the case to a downstream side in a conveyance direction of the toner and configured to form the replenishment path which communicates the storage chamber with the destination, wherein the conveying screw is disposed over the storage chamber and the replenishment path, and the through hole is formed in the area surrounded by the conveying shaft part and the two blade plates of the conveying blade disposed in the replenishment path.

7. The toner container according to claim 5, wherein the container main body is formed in a box shape extending in a longitudinal direction and having a length in a depth direction perpendicular to the longitudinal direction shorter than a longitudinal length, and the conveying screw is provided in a posture where its axial direction extends in the depth direction of the container main body.

8. An image forming apparatus comprising:

the toner container according to claim 5.

* * * * *